US009831020B2

(12) United States Patent
Gabor et al.

(10) Patent No.: US 9,831,020 B2
(45) Date of Patent: Nov. 28, 2017

(54) METHOD OF PRODUCTION OF GRAIN-ORIENTED SILICON STEEL SHEET GRAIN ORIENTED ELECTRICAL STEEL SHEET AND USE THEREOF

(71) Applicant: ARCELORMITTAL INVESTIGACIÓN Y DESARROLLO, S.L., Sestao Bizkaia (ES)

(72) Inventors: Ban Gabor, Schermbeck (DE); Tom Van De Putte, Sinaai (BE)

(73) Assignee: ARCELORMITTAL INVESTIGACION Y DESARROLLO, S.L., Sestao Bizkaia (ES)

( * ) Notice: Subject to any disclaimer, the term of this patent is extended or adjusted under 35 U.S.C. 154(b) by 308 days.

(21) Appl. No.: 14/418,847

(22) PCT Filed: Jul. 30, 2013

(86) PCT No.: PCT/IB2013/001657
§ 371 (c)(1),
(2) Date: Jan. 30, 2015

(87) PCT Pub. No.: WO2014/020406
PCT Pub. Date: Feb. 6, 2014

(65) Prior Publication Data

US 2015/0155085 A1 Jun. 4, 2015

(30) Foreign Application Priority Data

Jul. 31, 2012 (WO) ..... PCT/IB2012/001475

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/16*** | (2006.01) |
| ***H01F 1/147*** | (2006.01) |
| ***C21D 9/46*** | (2006.01) |
| ***C22C 38/06*** | (2006.01) |
| ***C22C 38/12*** | (2006.01) |
| ***C22C 38/14*** | (2006.01) |
| ***H01F 27/245*** | (2006.01) |

(52) U.S. Cl.
CPC ..... *H01F 1/14783* (2013.01); *C21D 8/12* (2013.01); *C21D 8/1205* (2013.01); *C21D 8/1222* (2013.01); *C21D 8/1233* (2013.01); *C21D 8/1261* (2013.01); *C21D 8/1272* (2013.01); *C21D 8/1283* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *H01F 27/245* (2013.01); *C21D 2201/05* (2013.01); *C21D 2211/004* (2013.01)

(58) Field of Classification Search
CPC ..... C21D 8/12–8/1283; C21D 9/46; C22C 38/001–38/16
See application file for complete search history.

(56) References Cited

U.S. PATENT DOCUMENTS

| | | | | |
|---|---|---|---|---|
| 5,759,294 | A | 6/1998 | Boelling | |
| 2009/0301157 | A1 | 12/2009 | Schuster | |
| 2010/0300583 | A1 * | 12/2010 | Abbruzzese | C21D 8/12 148/208 |
| 2013/0074996 | A1 | 3/2013 | Omura et al. | |

FOREIGN PATENT DOCUMENTS

| | | |
|---|---|---|
| CN | 102605267 | 7/2012 |
| EP | 0709470 | 5/1996 |
| EP | 2077164 | 7/2009 |
| EP | 2272995 | 1/2011 |
| EP | 2390373 | 11/2011 |
| JP | 2012140698 | 7/2012 |
| WO | 9846802 | 10/1998 |
| WO | WO 98/46802 | * 10/1998 |
| WO | 2011105054 | 9/2011 |

OTHER PUBLICATIONS

Kubota et al., Recent Progress and Future Trend on Grain-Oriented Silicon Steel, Journal of Magnitism and Magnetic Materials, 20000601 Elsevier Science Publishers Amsterdam, NL, vol. 215-216, pp. 69-73.

* cited by examiner

*Primary Examiner* — Colleen Dunn
(74) *Attorney, Agent, or Firm* — Davidson, Davidson & Kappel, LLC; Jennifer L. O'Connell; William C. Gehris

(57) ABSTRACT

The present invention is directed at a method of production gain oriented Fe—Si steel sheet presenting an induction value at 800 A/m above 1.870 Tesla and a core power loss lower than 1.3 W/kg at a specific magnetic induction of 1.7 Tesla (T). The steel chemical composition comprises, in weight percentage: 2.8≤Si≤4, 0.20≤Cu≤0.6, 0.05≤Mn≤0.4, 0.001≤Al≤0.04, 0.025≤C≤0.05, 0.005≤N≤0.02, 0.005≤Sn≤0.03, S≤0.015 and optionally Ti, Nb, V or B in a cumulated amount below 0.02, the following relationships being respected: Mn/Sn≤40, 2.0≤C/N≤5.0, Al/N≤1.20, and the balance being Fe and other inevitable impurities.

15 Claims, No Drawings

METHOD OF PRODUCTION OF GRAIN-ORIENTED SILICON STEEL SHEET GRAIN ORIENTED ELECTRICAL STEEL SHEET AND USE THEREOF

The present invention relates to a method of production of magnetic properties Fe—Si grain oriented electrical steels. Such material is used, for instance, in the manufacturing of transformers.

BACKGROUND

Imparting magnetic properties to Fe—Si grain oriented steel is the most economical source of magnetic induction. From a chemical composition standpoint, adding silicon to iron is a very common way to increase electrical resistivity, hence improving magnetic properties, and reducing at the same time the total power losses. Two families presently co-exist for the construction of steels for electrical equipment: grain oriented and non oriented grain steels.

The so-called Goss texture {110}<001> conveys remarkable magnetic properties to the grain oriented steel when the crystallographic plane {110} is, ideally, parallel to the rolling plane and the crystallographic direction <001> is, ideally, parallel to the rolling direction. The latter rolling direction corresponds to the direction of easy magnetization.

The ferritic grains which constitute the matrix of Fe—Si grain oriented steels and have crystallographic orientations close to the ideal {110}<001> are usually called Goss grains.

The following properties are used to evaluate the efficiency of electrical steels when it comes to magnetic properties:

- The magnetic induction, expressed in Tesla, which will be called J800 in this document as a reference to its measurement in an applied magnetic field of 800 A/m. Such value indicates how close the grains are to the Goss texture, the higher the better.
- The core power loss, expressed in W/kg, measured at a specific magnetic induction expressed in Tesla (T) and working rate in Hertz. The lower the total losses, the better.

A lot of metallurgical parameters may influence the above mentioned properties and the most common ones are: the material texture, the ferritic grain size, precipitates size and distribution, the material thickness, the isolating coating and an eventual superficial thermal treatment. Henceforth, the thermo-mechanical processing from the cast to an eventual superficial thermal treatment is essential to reach the targeted specifications.

On a one hand, regarding high magnetic flux density sheets, EP 2 077 164 discloses a method of production of grain oriented silicon grades with B10≥1.90 T using C: 0.010 to 0.075%, Si: 2.95 to 4.0%, acid soluble Al: 0.010 to 0.040%, N: 0.0010 to 0.0150% and one or both of S and Se in 0.005 to 0.1%, the balance being Fe and unavoidable impurities. The bar produced after casting has a thickness ranging between 20 and 70 mm. One of the following elements can be added in the chemical composition given above: Sb: 0.005 to 0.2%, Nb: 0.005 to 0.2%, Mo: 0.003 to 0.1, Cu: 0.02 to 0.2%, and Sn: 0.02 to 0.3%. The minimum temperature allowed before hot rolling is 1200° C. Such processing route is rather energy consuming since keeping a bar above 1200° C. or even 1250° C. after the cast would require more energy even if the bar is immediately hot rolled.

On the other hand, US 2009/0301157 relates to a method and a system for the production of hot-rolled strip silicon-alloy steel for further processing into grain-oriented sheets. The slab that is cast has a maximum thickness of 120 mm. The invention needs an intake temperature of the cast product into the hot-rolling line of at least 1200° C., and preferably in excess of 1250° C. No chemical composition is disclosed since the invention refers to a method and a system aiming at being multifunctional. The slab reheating, as mentioned before is an important step and is here twofold: A first preheating stage takes place and is followed by an intensive heating stage. Such processing route is rather energy consuming since the cast product shall be reheated in the intensive heating stage referenced as number 6 in the graph of the system lay out in the document.

SUMMARY OF THE INVENTION

The present invention provides a method of production cold rolled Fe—Si steel sheet comprising the successive steps consisting in:

- melting a steel composition that contains in weight percentage:
  - 2.8≤Si≤4
  - 0.4≤Cu≤0.6,
  - 0.05≤Mn≤0.4,
  - 0.001≤Al≤0.04,
  - 0.025≤C≤0.05
  - 0.005≤N≤0.02,
  - 0.005≤Sn≤0.03
  - S<0.015
- And optionally Ti, Nb, V or B in a cumulated amount below 0.02,
  - the following relationships being respected:
    - Mn/Sn≤40,
    - 2.0≤C/N≤5.0
    - Al/N≥1.20
  - and the balance being Fe and other inevitable impurities
- continuously casting said steel to obtain a slab which thickness is not higher than 80 millimeters, so that, after the solidification, said slab surface does not cool below 850° C. for longer than 5 minutes,
- reheating of said slab up to a temperature between 1080° C. to 1200° C. for 20 minutes at least.
- subsequently, hot rolling said slab with a first thickness reduction taking place while said slab temperature is above 1060° C. and last thickness reduction taking place above a finish rolling temperature of 950° C. in order to obtain a hot band,
- cooling down said band to a temperature ranging between 500° C. and 600° C. within less than 10 seconds, then
- coiling the hot band wherein the precipitate structure formed after the steps of hot rolling, fast cooling and coiling leads to precipitation of less than 60% of the $Al_{as}$ (acid soluble Al), said precipitate structure does not contain AlN precipitates in the size range between 5 nm and 150 nm at all, then
- cleaning its surface,
- carrying out a first cold rolling step of the hot band with a cold rolling ratio of at least 60% without having previously annealed said hot band, then
- performing a primary recrystallization annealing step at a temperature $T_1$ between 780° C. and 920° C., the steel being held at $T_1$ for a minimum time $t_1$ of 2 minutes in an atmosphere composed of a mixture of hydrogen, nitrogen and water vapor, then cooling to room temperature so as to obtain a steel carbon content below 0.004% and a primary average grain size below 16 micrometers after the cooling, carrying out a second cold rolling step with a cold rolling ratio of at least 50% to obtain the cold rolled steel sheet final thickness, depositing a layer of an isolating separator on the surface of said cold rolled steel sheet, the isolated cold rolled steel sheet goes through a secondary annealing in an atmosphere containing hydrogen and nitrogen, the steel heating rate V1 being below 15° C. per hour between 600° C. and 1150° C., the sheet temperature being held at a minimum temperature $T_2$ of 1150° C. for a minimum time $t_2$ of 600 minutes, the annealing total time being above 120 hours so as reduce the content for each of sulfur and nitrogen below 0.001% and to have a secondary average grain size below 15 millimeters, performing a slow cooling down to room temperature.

Preferably, the copper content is between 0.4% and 0.6%.

Preferably, the sulfur content is lower than 0.010%.

In a preferred embodiment, the steel carbon content is between 0.025% and 0.032%.

Preferably, said slab is cast with a minimum speed of 4.0 meters per minute.

In a preferred embodiment, said Finish Rolling Temperature is at least 980° C.

Preferably, the grain oriented steel sheet is coated with insulation and tension coating based on colloidal silica emulsion.

Preferably, after the primary annealing, the carbon content of the steel is below 0.0025%.

In a preferred embodiment, after the primary annealing, the primary average grain size is below 10 micrometers.

In another preferred embodiment, after the secondary annealing, the secondary average grain size is below 10 millimeters.

In a preferred embodiment, the grain oriented steel sheet obtained by the method according to the invention presents an induction value at 800 A/m above 1.870 Tesla and a core power loss lower than 1.3 W/kg at a specific magnetic induction of 1.7 Tesla (T).

A part made of a grain oriented steel sheet according to the invention can be used to obtain a power transformer.

DETAILED DESCRIPTION

In order to reach the desired properties, the steel according to the invention includes the following elements.

First of all, it contains silicon between 2.8 and 4% so as to obtain the Goss texture and to increase the steel electric resistivity. If the content is lower than 2.8%, the high magnetic properties of the grain oriented steel and the low core power loss value will not be reached. On the other hand, if the addition of silicon goes beyond 4%, cracking sensitivity during cold rolling reaches an unacceptable level.

Sulfur content is strictly lower than 0.015% (150 ppm) so as to avoid segregations near the center line of the cast slab. These segregations damage the homogeneity of the produced hot rolled microstructure and precipitate distribution. In order to homogenise the sulfur concentration over the slab thickness, the slab reheating temperature would have to be raised and the slab would have to be kept at high temperature for longer time, impairing productivity and increasing production costs. In addition, if sulfur content is above 150 ppm, the purification stage during the High Temperature Annealing (HTA), in which harmful elements like S, N and the likes are removed by interaction with a dry atmosphere containing more than 75% of hydrogen, will become too long, impairing quality, productivity and increasing costs. Indeed, this long purification stage is costly and it degrades the glass film quality. To decrease the appearance risks of all these defects, preferably, sulfur content is lower than 100 ppm. Actually, during the holding, the hydrogen concentration in the atmosphere should be above 75% in order to ensure the necessary metal purification by removing the nitrogen and sulfur which are dissolved in the steel. This happens by interaction with the hydrogen atmosphere, up to a level that the total nitrogen and total sulfur concentration in the steel is preferably below 100 ppm.

The steel further contains copper between 0.20 and 0.6% to improve the J800 value of the steel. During annealing, copper precipitates to produce nanometric precipitates that may act as nuclei for the further precipitation of AlN. If the copper content is below 0.20%, the quantity of Cu precipitates is too low, leading to a J800 value under the target, however, copper is known to decrease the saturation polarization of the metal and as a result the J800 target of 1.870 T becomes unreachable for copper contents above 0.6%. Preferably, copper content is between 0.4% and 0.6%.

Manganese concentration should be higher than 0.05% to avoid cracking during the hot rolling stage. Further Mn is added to control recrystallization. Mn concentrations exceeding 0.4% increase the alloying cost unnecessarily and decrease the saturation magnetization, leading to J800 value under the target. Manganese is added to the steel in content between 0.05 and 0.4%. This element precipitates with Sulfur to produce precipitates of MnS that may also act as nuclei for the further precipitation of AlN. The minimum amount of Mn is therefore of 0.05%.

Tin (Sn) is a grain boundary segregating element which can be added to control the grain size of primary and secondary recrystallized structure. Sn concentration should be at least 0.005% to be effective in avoiding excessive grain growth during high temperature annealing and hence decrease the magnetic losses. When Sn concentration exceeds 0.03%, the recrystallization becomes irregular. Sn content should therefore be limited to a maximum value of 0.03%. Tin content is between 0.010% and 0.022% in a preferred embodiment so as to serve as grain boundaries segregating elements which reduce the grain boundary mobility. The grain growth would therefore be hindered. Tin can be replaced by molybdenum or antimony.

The ratio of manganese to tin (Mn/Sn) shall be below or equal to 40 so as to control the grain size distribution through the recrystallization, in a preferred embodiment: $Mn/Sn \leq 20$.

The primary average grain size target is below 16 micrometers, preferably below 10 micrometers.

Aluminum is added in the steel in the range of 0.001 to 0.04% so as to precipitate with nitrogen, forming AlN as an inhibitor of the grain growth during secondary recrystallization. The amount of Al refers to the acid soluble aluminum which is the amount of aluminum not bound with oxygen. In order to have the suitable amount of AlN, aluminum must be below 0.04% because above the control of the precipitation kinetic becomes more and more difficult. Al content must be above 0.001% to have enough AlN.

Nitrogen must be in the range from 0.005 to 0.02% so as to form enough AlN precipitates. Nitrogen content can not go beyond 0.02% due to undesired ferro-nitrides or carbo-nitrides formation, below 0.005% the quantity of AlN is too low.

The weight ratio of aluminum to nitrogen shall be above or equal to 1.20 (Al/N≥1.20), to have a favorable atomic ratio of Al and N for the AlN precipitation kinetic and amount. The low amount of nitrogen compared to aluminum leads to the formation of finer precipitates which are helpful for their inhibition role. Preferably, the ratio of Al/N is as follows: Al/N≥1.5.

In a preferred embodiment, less than 60% of the acid soluble aluminum in the hot band is in precipitated form as AlN, which precipitate structure does not contain AlN precipitates in the size range of 5 nm and 150 nm at all.

Regarding the carbon content, it has been verified that, at the hot rolling step, C concentration significantly affects the hot band microstructure and crystallographic texture through control over the austenite amount during hot rolling. Carbon concentration also affects the inhibitor formation as it prevents early and coarse precipitation of AlN during hot rolling. The C content should be above 0.025% to form enough austenite to keep precipitates in solution and to control the hot band microstructure and texture. A limit of 0.05 exists not to have a too long decarburizing step, which would be an economical disadvantage since it slows down productivity. Preferably, the carbon content is between 0.025% and 0.032% which concentration range has proven to yield the highest J800 values in the final product.

The ratio of carbon to nitrogen shall be between 2 and 5 (2≤C/N≤5) to guarantee that the J800 value is above 1.870 T. If C/N ratio is below 2, the austenite content during hot rolling will be insufficient. Nitrogen being more soluble into austenite that into ferrite will diffuse into austenite and not be finally uniformly distributed into the hot rolled microstructure, impairing an efficient precipitation with aluminum. On the other side, if the C/N ratio goes beyond 5 the decarburization process might be long and difficult in case of high C or AlN formation insufficient if the nitrogen content is too low. Preferably, the ratio of C/N is: 3≤C/N≤5.

Micro alloying elements such as titanium, niobium, vanadium and boron are limited and the sum of these micro alloying elements does not exceed 0.02%. As a matter of fact, these elements are nitride formers which consume the nitrogen needed to form aluminum nitride inhibitors as mentioned above, hence their content shall be consistent with impurity levels.

Other impurities are: As, Pb, Zn, Zr, Ca, O, P, Cr, Ni, Co, Sb, B, and Zn.

The process according to the invention shortens the production workflow from the liquid phase steel to the finished hot-rolled strip. The complete production process takes place continuously and the achievable strip thickness range is between 1 mm to 80 mm.

The process according to the invention provides an excellent quality hot band as a primary material, in terms of stability of the microstructure, texture and precipitates over the length and the width of the hot rolled coil. Furthermore hot band annealing treatment is avoided due to the excellent quality of the hot band.

Indeed, the process according to the invention results in slab thicknesses up to five times less than conventional slabs. The maximum slab thickness is 80 mm.

It is essential to avoid that the slab surface temperature goes below 850° C. for longer than 5 minutes so as to avoid premature AlN precipitation. Such a precipitation would hinder AlN inhibition role capacity because they will get coarser though the process and be useless down the metallurgical route during production. In such case another thermal treatment to dissolve the precipitates and bring back precipitation elements such as nitrogen, for instance, into solution would be necessary. This operation would require high temperature and long holding times for homogenization, impairing productivity and increasing production cost. To achieve this, one solution is to select a minimum casting speed of 4 meters per minute. It is also one important feature of the invention to allow slab reheating strictly below 1250° C. and even below 1200° C., this is a strong cost saving feature for the invention.

Afterwards, the slab is reheated at a minimum temperature of 1080° C. for 20 minutes. Below 1080° C., the hot rolling step might lead to a FRT under 950° C. where precipitation of AlN will start to occur. Such early precipitation will generate a decrease of favorable texture for Goss grain orientations and a decrease of inhibition forces. The inhibition force being the overall Zener pinning force which is exerted by fine distribution precipitates on the grain boundaries to prevent them from coarsening.

Reheating is used to homogenize the temperature in the slab so as to have the same temperature at every point of the slab and dissolve potentially existing precipitates.

In the hot rolling mill, the first reduction roll temperature entry shall be above 1060° C. to avoid a FRT falling below 950° C. since there is no thermal energy input throughout the hot rolling stage from the entry to the last stand. If the FRT is below 950° C., the texture will not be significantly affected but the inhibition force of precipitates will be too weak and the J800 target of 1.870 T will not be reached with the invention chemical composition and processing route. After the finishing rolling step, a maximum timeframe of 10 seconds is given before starting the hot band cooling. This cooling aims at avoiding the precipitation of coarse aluminum nitrides, those precipitates ought to be formed at low temperatures.

Ideally, the FRT is above 980° C. to maximize the inhibition force which will be stored in the matrix and be used down the production route to trigger recrystallization and inhibition precipitations.

The coiling temperature takes place between 500° C. and 600° C. because out of this range, the targeted precipitates of the invention containing AlN will not have the proper distribution and size.

A hot rolled band is obtained at this step. The avoidance of the application of classical hot band annealing process for grain oriented electrical steels production before the cold rolling step is an additional feature of the invention with energy consumption benefits. The hot rolling step leads to a hot band with the following micro-structural features:

Any through thickness cross section cut of the hot band containing the rolling direction shows three equal parts: two external symmetrical areas comprising equiaxed terrific grains and the internal one covering one third of the thickness which contains a mixture of small equiaxed and larger pancake grains.

Other particular characteristic of the hot band is that in the two external areas shear deformation textures like the zeta fiber (110)[x,y,z] as well as the Cu (112)[−1,−1,1] are dominant, while in the internal third zone, the Θ (001) [x,y,z] and the α (u, v, w)[1,−1,0] fibers are the most dominant components.

Further particularity of the hot band quality lies in the presence of AlN precipitates formed during the hot rolling, cooling and coiling steps. The partial precipitation of acid soluble aluminum in above mentioned AlN presents a special feature: In a preferred embodiment, the precipitated structure does not contain aluminum nitride precipitates (AlN) with sizes between 5 nanometers and 150 nanometers. Precipitates in this range coarsen too much in the subsequent processing route and when the precipitates are coarse they have very poor inhibition capacity, the J800 value will decrease and may fall below 1.870 T.

The hot band surface is cleaned using the pickling process or any alternative so as to remove any oxide layer or any type of other residues of secondary scale Subsequently, a first cold rolling process takes place; it is applied with at least 2 steps of passes and leads to an intermediate thickness below 1 mm using a minimum cold rolling ratio of 60%. Lower deformation degrees would not guarantee enough stored energy to activate and reach the upcoming desired recrystallization and precipitation levels for the grain growth.

The first cold rolling step is followed by an intermediate annealing also called primary annealing or decarburization annealing in the invention as a single or multistep process, providing the primary recrystallization and the material decarburizing. After the decarburizing, carbon content is preferably below 0.0025%. Elements such as carbon and carbides are pinning locations for the magnetic domain walls. In addition, the average grain size after the primary annealing, must be below 16 micrometers because if the grains are coarse at this step, meaning they are above 16 μm, an inheritage phenomenon will lead to even coarser grains with a significantly heterogeneous microstructure made of small and big grains. The core loss will also increase significantly with grain sizes above 16 μm for the primary recrystallized structure.

This intermediate annealing $T_1$, also called primary annealing, is carried out between 780° C. and 920° C. for a minimum soaking time $t_1$ of 2 minutes. The slightly oxidizing atmosphere of the annealing is a mixture of hydrogen, nitrogen and water vapor combined so as to decrease the steel carbon content below 0.004% in weight percent and the primary grain size is kept below 16 micrometers. In a preferred practice of the invention, the carbon content is, at this stage, kept below 0.0025% and the ferritic grain size is kept below 10 micrometers. Such combination improves the primary texture which will be further cold rolled so as to have the best Goss texture to reach J800 above 1.870 Tesla with the invention chemical composition and processing route.

Afterwards, the material undergoes a second cold rolling step with a minimum cold rolling ratio of 50% applied with at least two steps of passes. Generally the thickness after the second cold rolling is between 0.21 and 0.35 mm.

The next step consists in the deposition of an isolating separator coating, for example MgO based coating. Such separator is applied on the surface of the secondly cold rolled electrical steel, after which the strip is coiled up.

Subsequently, a high temperature annealing (HTA), also called secondary annealing, is carried out and performed in an atmosphere made of a mixture of hydrogen and nitrogen. The heating rate from 400° C. to 1150° C. is below 15° C./s. Once the minimum soaking temperature $T_2$ of 1150° C. is reached, a holding time $t_2$ of a minimum of 10 hours takes place. After the holding, a slow cooling is carried out so that the total amount of the secondary annealing time is superior to 120 hours. Once the secondary annealing is done, the sulfur and nitrogen content in the matrix is below 0.001% each and the average grain size of the steel is below 15 mm. In a preferred embodiment, after the secondary annealing, the average grain size is below 10 millimeters. Such mean grain size minimizes the core losses since this thickness dependant parameter increases sharply with grain size.

After the secondary annealing, insulation and tension coating is applied on the steel surface. It is based on colloidal silica emulsion and guarantees an optimal tension as well as it improves the steel electrical resistivity.

The so called near highly grain oriented steel sheet according to the invention presents a steel with induction level at 800 A/m above 1.870 Tesla and core power loss under 1.3 W/kg.

The following examples are for the purposes of illustration and are not meant to be construed to limit the scope of the disclosure herein:

The alloy chemistries are given in table 1. The cast were done using the process according to the invention to produce slabs which thickness is below 80 mm. The heat number (Heat N°) identifies the different chemical compositions from 1 to 10. Chemical composition elements in bold and underlined are not according to the invention.

TABLE 1

Chemical compositions (in weight percent) of the different alloys, bold and underlined are not according to the invention

| Heat Nr | C | Si | Mn | P | S | Cu | Sn | V | Nb | Ti | N | B | Al |
|---|---|---|---|---|---|---|---|---|---|---|---|---|---|
| 1 | 0.032 | 3.10 | 0.21 | 0.008 | 0.003 | 0.48 | 0.024 | 0.00 | 0.00 | 0.01 | 0.009 | 0.000 | 0.01 |
| 2 | 0.038 | 2.97 | 0.23 | 0.009 | 0.005 | 0.49 | 0.020 | 0.01 | 0.00 | 0.00 | 0.010 | 0.000 | 0.01 |
| 3 | 0.032 | 3.10 | 0.21 | 0.009 | 0.004 | 0.47 | 0.027 | 0.01 | 0.00 | 0.01 | 0.009 | 0.001 | 0.01 |
| 4 | 0.030 | 2.85 | 0.22 | 0.009 | 0.005 | 0.48 | 0.022 | 0.01 | 0.00 | 0.00 | 0.010 | 0.000 | 0.01 |
| 5 | 0.030 | 2.85 | 0.22 | 0.009 | 0.005 | 0.48 | 0.022 | 0.01 | 0.00 | 0.00 | 0.010 | 0.000 | 0.01 |
| 6 | 0.030 | 2.85 | 0.22 | 0.009 | 0.005 | 0.48 | 0.022 | 0.01 | 0.00 | 0.00 | 0.010 | 0.000 | 0.01 |
| 7 | 0.035 | 3.07 | 0.22 | 0.008 | 0.003 | 0.48 | 0.018 | 0.00 | 0.01 | 0.00 | 0.012 | 0.000 | 0.01 |
| 8 | **0.068** | 2.94 | 0.20 | 0.012 | 0.004 | 0.49 | **0.004** | 0.00 | 0.00 | 0.00 | 0.012 | 0.001 | 0.02 |
| 9 | 0.041 | 3.03 | 0.20 | 0.007 | 0.004 | 0.48 | **0.004** | 0.01 | 0.00 | 0.00 | 0.009 | 0.001 | 0.01 |
| 10 | 0.041 | 3.1 | 0.2 | 0.0062 | 0.004 | 0.47 | 0.005 | 0.00 | 0 | 0.01 | 0.010 | 0 | 0.0158 |

In the table 2 below, the associated ratios of chemical composition elements are shown for heat numbers 1 to 10:

TABLE 2

Chemical element ratios (bold and underlined are not according to the invention)

| Heat Nr | Al/N | Mn/Sn | C/N | Ti + Nb + V + B |
|---|---|---|---|---|
| 1 | 1.74 | 9 | 3.8 | 0.009 |
| 2 | 1.21 | 12 | 3.6 | 0.013 |
| 3 | 1.47 | 8 | 3.4 | 0.014 |
| 4 | 1.20 | 10 | 3.0 | 0.015 |
| 5 | 1.20 | 10 | 3.0 | 0.015 |
| 6 | 1.20 | 10 | 3.0 | 0.015 |
| 7 | **1.11** | 12 | 2.9 | 0.013 |
| 8 | 1.44 | **46** | **5.7** | 0.010 |
| 9 | 1.68 | **47** | 4.8 | 0.015 |
| 10 | 1.61 | **44** | 4.2 | 0.009 |

After the solidification, each cast slab surface does not cool below 850° C.

The process parameters undergone by each heat number (1 to 10) are shown in table 3 here below where:

SRT (° C.): is the slab reheating temperature. This temperature is held for a time above 20 minutes and below 1 hour.

F1 is the temperature of the first thickness reduction.

FRT (° C.): is the slab finish rolling temperature where the last thickness reduction takes place.

Coiling T (° C.): is the coiling temperature

TABLE 3

Hot rolling parameters (bold and underlined is not according to the invention)

| Heat Nr | SRT: | F1 | FRT | Coiling T ° |
|---|---|---|---|---|
| 1 | 1165 | 1110 | 988 | 567 |
| 2 | 1175 | 1111 | 956 | 566 |
| 3 | 1165 | 1104 | 988 | 567 |
| 4 | 1175 | 1110 | 962 | 561 |
| 5 | 1170 | 1106 | 957 | 581 |
| 6 | 1174 | 1110 | 963 | 566 |
| 7 | 1164 | 1133 | 966 | 552 |
| 8 | 1096 | **1038** | 969 | 569 |
| 9 | 1174 | 1105 | 957 | 569 |
| 10 | 1099 | 1100 | **927** | 578 |

After the coiling, the hot band surface is cleaned, and then a first cold rolling (above 60%) takes place. The primary recrystallization annealing step has been carried out on each alloy (heat numbers 1 to 10) with $T_1$ between 780 and 920° C. for more than 2 minutes ($t_1$) in an atmosphere made of a mixture of hydrogen, nitrogen and water vapor followed by a cooling to room temperature. The carbon content of all alloys is below 0.004%.

Then a second cold rolling takes place (>50%) so as to obtain the final thickness of 0.3 mm for each steel alloy 1 to 10.

Finally, an isolating separator based on colloidal silica emulsion is deposited on the steel surface then the steel undergoes a High Temperature Annealing (HTA) cycle known per se: It is heated at a rate below 15° C. per hour up to a temperature comprised between 600 and 1150° C. for more than 10 hours. Sulfur and nitrogen contents are below 0.001% for all the alloys.

Measured grain sizes after primary recrystallization annealing step and secondary annealing are shown in table 4 as well as J800 and P1.7:

DCA Gsize: is the grain size after decarburization annealing, i.e. the primary recrystallization annealing step. It is expressed in micrometers.

Final GSize: is the final grain size after the secondary annealing. It is expressed in millimeters.

J800: is the magnetic induction, expressed in Tesla, and measured at a magnetic field of 800 A/m.

P 1.7: is the core power loss, expressed in W/kg, and measured at a specific magnetic induction of 1.7 Tesla (T). The core loss is measured according to standard UNI EN 10107 and IEC 404-2.

TABLE 4 primary and secondary annealing grain sizes and alloy properties of heat numbers 1 to 10 (bold and underlined is not according to the invention)

| Heat Nr | Type | J800 | p1.7 | DCA G size (μm) | Fin G size (mm) |
|---|---|---|---|---|---|
| 1 | Invention | 1.880 | 1.18 | 15.3 | 5.0 |
| 2 | Invention | 1.871 | 1.25 | — | — |
| 3 | Invention | 1.878 | 1.18 | — | — |
| 4 | Invention | 1.876 | 1.22 | — | — |

TABLE 4-continued primary and secondary annealing grain sizes and alloy properties of heat numbers 1 to 10 (bold and underlined is not according to the invention)

| Heat Nr | Type | J800 | p1.7 | DCA G size (μm) | Fin G size (mm) |
|---|---|---|---|---|---|
| 5 | Invention | 1.875 | 1.23 | — | — |
| 6 | Invention | 1.876 | 1.19 | — | — |
| 7 | reference | **1.864** | 1.19 | — | — |
| 8 | reference | **1.838** | **1.79** | — | — |
| 9 | reference | **1.854** | 1.26 | — | — |
| 10 | reference | **1.840** | 1.30 | 10.8 | 14.2 |

As shown from table 4, heat N° to 6 are according to the invention: Those heats present alloying element compositions according to the invention. In addition, those have undergone process parameters according to the invention and have yielded induction value at 800 A/m above 1.870 Tesla and a core power loss below 1.3 W/kg at 1.7 Tesla. They have been produced using the process according to the invention. The heat number 1 presents the best result in terms of magnetic induction since it presents the preferred ratios of alloying elements.

References 7 to 10 are not according to the invention:

Reference no 7 presents a ratio of Al/N below 1.20. As a consequence, the J800 value is below 1.870 Tesla.

Reference no 8 presents carbon and tin contents outside of the range according to the invention. In addition, the ratios of Mn/Sn and C/N are not according to the invention and, finally F1 is below 1060. As a result, the J800 value is the worst one below 1.870 Tesla and the core loss is significantly above the maximum accepted of 1.3 W/kg.

Reference no 9 presents tin content not according to the invention and the ratio of Mn/Sn is above 40. As a result, the J800 value is below 1.870 Tesla.

Reference no 10 presents chemical composition according to the invention but the ratio of Mn/Sn is above the maximum limit of 40 and the FRT is below the limit, as a consequence, the induction value J800 is below 1.870 Tesla.

Grain oriented FeSi steel sheets according to the invention can be profitably used for the production of transformers with, for instance, J800 requirements between 1.870 T and 1.90 T.

What is claimed is:

1. A method of production of cold rolled Fe—Si steel sheet comprising the steps of:

melting a steel composition that contains in weight percentage:

$2.8 \leq Si \leq 4$ $0.4 \leq Cu \leq 0.6$, $0.05 \leq Mn \leq 0.4$, $0.001 \leq Al \leq 0.04$, $0.025 \leq C \leq 0.05$ $0.005 \leq N \leq 0.02$, $0.005 \leq Sn \leq 0.03$, and $S < 0.015$ the following relationships being respected:

$Mn/Sn \leq 40$, $2.0 \leq C/N \leq 5.0$, and $Al/N \geq 1.20$ and the balance being Fe and other inevitable impurities;

producing said hot rolled sheet to produce a slab having a thickness that is 80 millimeters or less, so that, after the solidification, said slab surface does not cool below 850° C. for longer than 5 minutes;

reheating of said slab up to a temperature between 1080° C. to 1200° C. for at least 20 minutes;

subsequently, hot rolling said slab with a first thickness reduction taking place while said slab temperature is above 1060° C. and a last thickness reduction taking place above a finish rolling temperature of 950° C. in order to obtain a hot band, cooling down said band to a temperature ranging between 500° C. and 600° C. within less than 10 seconds, then coiling the hot band wherein less than 60% of acid soluble Al is in precipitated form at the hot band, said precipitate does not contain AlN precipitates in the size range between 5 nm and 150 nm at all then, cleaning its surface, then carrying out a first cold rolling step of the hot band with a cold rolling ratio of at least 60% without having previously annealed said hot band, then performing a primary recrystallization annealing step at a temperature $T_1$ between 780° C. and 920° C., the steel being held at $T_1$ for a minimum time $t_1$ of 2 minutes in an atmosphere composed of a mixture of hydrogen, nitrogen and water vapor, then cooling to room temperature so as to obtain a steel carbon content below 0.004% and a primary average grain size below 16 micrometers after the cooling, then carrying out a second cold rolling step with a cold rolling ratio of at least 50% to obtain the cold rolled steel sheet final thickness, then depositing a layer of an isolating separator on the surface of said cold rolled steel sheet, then performing a secondary annealing of the isolated cold rolled steel sheet in an atmosphere containing hydrogen and nitrogen, the steel heating rate V1 being below 15° C. per hour between 600° C. and 1150° C., the sheet temperature being held at a minimum temperature $T_2$ of 1150° C. for a minimum time $t_2$ of 600 minutes, the annealing total time being above 120 hours so as reduce the content for each of sulfur and nitrogen below 0.001% and to have a secondary average grain size below 15 millimeters, then performing a slow cooling down to room temperature.

2. A method of production of cold rolled Fe—Si steel sheet according to claim 1 wherein the sulfur content is less than 0.010%.

3. A method of production of cold rolled Fe—Si steel sheet according to claim 1 wherein the carbon content is from 0.025% to 0.032%.

4. A method of production of cold rolled Fe—Si steel sheet according to claim 1 wherein said slab is cast with a minimum speed of 4.0 meters per minute.

5. A method of production of cold rolled Fe—Si steel sheet according to claim 1 wherein said Finish Rolling Temperature is at least 980° C.

6. A method of production according to claim 1 wherein, the grain oriented steel sheet is coated with insulation and tension coating based on colloidal silica emulsion.

7. A method of production according claim 1 wherein, after the primary recrystallization annealing, the carbon content of the steel is below 0.0025%.

8. A method of production according to claim 1 wherein, after the primary annealing, the primary average grain size is below 10 micrometers.

9. A method of production according to claim 1 wherein, after the secondary annealing, the secondary average grain size is below 10 millimeters.

10. A method of production according to claim 1 wherein the steel composition includes Ti, Nb, V or B in a cumulated amount below 0.02.

11. A method of production according to claim 1 wherein the steps are performed successively.

12. A grain oriented steel sheet obtained by the method according to claim 1 presenting an induction value at 800 A/m above 1.870 Tesla and a core power loss lower than 1.3 W/kg at a specific magnetic induction of 1.7 Tesla (T).

13. A power transformer including a part made of the grain oriented steel sheet according to claim 12.

14. A method of production of a cold rolled Fe—Si steel sheet consisting of the following steps:

melting a steel composition that contains in weight percentage:

$2.8 \leq Si \leq 4$ $0.4 \leq Cu \leq 0.6$, $0.05 \leq Mn \leq 0.4$, $0.001 \leq Al \leq 0.04$, $0.025 \leq C \leq 0.05$ $0.005 \leq N \leq 0.02$, $0.005 \leq Sn \leq 0.03$, and $S < 0.015$ the following relationships being respected:

$Mn/Sn \leq 40$, $2.0 \leq C/N \leq 5.0$, and $Al/N \geq 1.20$ and the balance being Fe and other inevitable impurities;

producing said hot rolled sheet to produce a slab having a thickness that is 80 millimeters or less, so that, after the solidification, said slab surface does not cool below 850° C. for longer than 5 minutes;

reheating of said slab up to a temperature between 1080° C. to 1200° C. for at least 20 minutes;

subsequently, hot rolling said slab with a first thickness reduction taking place while said slab temperature is above 1060° C. and a last thickness reduction taking place above a finish rolling temperature of 950° C. in order to obtain a hot band, cooling down said band to a temperature ranging between 500° C. and 600° C. within less than 10 seconds, then coiling the hot band wherein less than 60% of acid soluble Al is in precipitated form at the hot band, said precipitate does not contain AlN precipitates in the size range between 5 nm and 150 nm at all then, cleaning its surface, then carrying out a first cold rolling step of the hot band with a cold rolling ratio of at least 60% without having previously annealed said hot band, then performing a primary recrystallization annealing step at a temperature $T_1$ between 780° C. and 920° C., the steel being held at $T_1$ for a minimum time $t_1$ of 2 minutes in an atmosphere composed of a mixture of hydrogen, nitrogen and water vapor, then cooling to room temperature so as to obtain a steel carbon content below 0.004% and a primary average grain size below 16 micrometers after the cooling, then carrying out a second cold rolling step with a cold rolling ratio of at least 50% to obtain the cold rolled steel sheet final thickness, then depositing a layer of an isolating separator on the surface of said cold rolled steel sheet, then performing a secondary annealing of the isolated cold rolled steel sheet in an atmosphere containing hydrogen and nitrogen, the steel heating rate V1 being below 15° C. per hour between 600° C. and 1150° C., the sheet temperature being held at a minimum temperature $T_2$ of 1150° C. for a minimum time $t_2$ of 600 minutes, the annealing total time being above 120 hours so as reduce the content for each of sulfur and nitrogen below 0.001% and to have a secondary average grain size below 15 millimeters, then performing a slow cooling down to room temperature.

15. A method of production according to claim 14 wherein the steps are performed successively.

* * * * *